US008950916B2

(12) United States Patent
Makiuchi et al.

(10) Patent No.: US 8,950,916 B2
(45) Date of Patent: Feb. 10, 2015

(54) VEHICLE LIGHT FITTING UNIT WITH A PLURALITY OF LIGHT SOURCES

(75) Inventors: Kazuya Makiuchi, Tokyo (JP); Hidetaka Okada, Tokyo (JP); Takuya Matsumaru, Tokyo (JP); Takashi Futami, Tokyo (JP); Koji Fukura, Wako (JP); Michio Furukawa, Wako (JP); Masanobu Shinoda, Wako (JP); Hideto Hosoda, Wako (JP); Masahiro Yamagiwa, Wako (JP); Yuji Tsuchiya, Wako (JP); Tomohiro Tsukada, Tochigi (JP)

(73) Assignees: Stanley Electric Co., Ltd., Tokyo (JP); Honda Motor Co., Ltd., Tokyo (JP)

( * ) Notice: Subject to any disclaimer, the term of this patent is extended or adjusted under 35 U.S.C. 154(b) by 467 days.

(21) Appl. No.: 13/167,339

(22) Filed: Jun. 23, 2011

(65) Prior Publication Data

US 2011/0317442 A1 Dec. 29, 2011

(30) Foreign Application Priority Data

Jun. 23, 2010 (JP) ..... 2010-142334

(51) Int. Cl.
*F21V 7/00* (2006.01)
*F21S 8/10* (2006.01)

(52) U.S. Cl.
CPC ..... *F21S 48/24* (2013.01); *F21S 48/215* (2013.01); *F21S 48/218* (2013.01); *F21S 48/23* (2013.01); *F21V 7/0008* (2013.01); *F21V 7/0025* (2013.01)
USPC ..... 362/516; 362/544; 362/247; 362/297; 362/346

(58) Field of Classification Search
USPC ..... 362/30, 516–519, 544, 247, 297, 298, 362/346
See application file for complete search history.

(56) References Cited

U.S. PATENT DOCUMENTS

| | | | | |
|---|---|---|---|---|
| 6,332,701 | B1 * | 12/2001 | Yamada et al. | 362/517 |
| 2008/0049436 | A1 * | 2/2008 | Yoshihara et al. | 362/488 |
| 2008/0186726 | A1 | 8/2008 | Okada | |
| 2009/0016052 | A1 | 1/2009 | Holder et al. | |
| 2010/0008088 | A1 | 1/2010 | Koizumi et al. | |

FOREIGN PATENT DOCUMENTS

| | | | |
|---|---|---|---|
| CN | 1598396 | A | 3/2005 |
| CN | 1752514 | A | 3/2006 |
| CN | 101131230 | A | 2/2008 |
| JP | 2007-188758 | A | 7/2007 |
| JP | 2008-47455 | A | 2/2008 |
| JP | 2008-186786 | A | 8/2008 |
| JP | 2010-21001 | A | 1/2010 |
| JP | 2010-61835 | A | 3/2010 |

OTHER PUBLICATIONS

Chinese Office Action for the related Chinese Application No. 201110170874.8 dated Jul. 25, 2014.

* cited by examiner

*Primary Examiner* — Jong-Suk (James) Lee
*Assistant Examiner* — Leah S Macchiarolo
(74) *Attorney, Agent, or Firm* — Kenealy Vaidya LLP

(57) ABSTRACT

Disclosed is a vehicle light fitting unit that can include a plurality of light sources, a reflecting plane which diffusely reflects light emitted from the plurality of light sources, and a lens which emits the light, which is diffusely reflected by the reflecting plane, to a front direction. The plurality of light sources can each be provided so that a pitch between one light source and another light source adjacent to the one light source is shorter than a light path length from the one light source to the lens passing through the reflecting plane.

10 Claims, 6 Drawing Sheets

VEHICLE LIGHT FITTING UNIT WITH A PLURALITY OF LIGHT SOURCES

This application claims the priority benefit under 35 U.S.C. §119 of Japanese Patent Application No. 2010-142334 filed on Jun. 23, 2010, which is hereby incorporated in its entirety by reference.

BACKGROUND

1. Field

The presently disclosed subject matter relates to a vehicle light fitting unit.

2. Description of Related Art

Conventionally, as a vehicle light fitting unit, there is known a technique in which light enters from a side of a light guiding body and the light is emitted from a front face of the light guiding body (for example, Japanese Patent Application Laid-Open Publication No. 2010-21001, Japanese Patent Application Laid-Open Publication No. 2008-186786).

As described in FIG. 6A and FIG. 6B, such vehicle light fitting unit 100 includes a light guiding body 101 including a plurality of reflecting dots D on a back face (rear face), a plurality of light sources 102, etc. such as an LED, etc. aligned along a side face (bottom face) of the light guiding body 101, and a light entering lens 103 for a light from the plurality of light sources 102, etc. to enter the light guiding body 101 efficiently. The light from the plurality of light sources 102, etc. which enters the light guiding body 101 through the light entering lens 103 is reflected by the reflecting dots on the rear face of the light guiding body 101 and exits from the front face of the light guiding body 101. As a result, light is emitted from the front face of the light guiding body 101.

However, with the above vehicle light fitting unit 100, the light is reflected by the reflecting dots D provided on the rear face of the light guiding body 101 to the front face of the light guiding body 101, and when the light guiding body 101 is viewed from the front, areas near the reflecting dots D are brighter than the other areas. In other words, unevenness of the brightness occurs between the areas near the reflecting dots D and the other areas, and light is not emitted evenly as a plane from the front face of the light guiding body 101.

SUMMARY

According to an aspect of the presently disclosed subject matter a vehicle light fitting unit can be provided in which light is emitted more evenly as a plane better than conventional techniques or units.

According to another aspect of the presently disclosed subject matter, there is provided a vehicle light fitting unit that can include:

a plurality of light sources;

a reflecting plane which diffusely reflects light emitted from the plurality of light sources; and a lens which emits the light, which is diffusely reflected by the reflecting plane, to a front direction, wherein the plurality of light sources are each provided so that a pitch between one light source and another light source adjacent to the one light source is made shorter than a light path length from the one light source to the lens passing through the reflecting plane.

BRIEF DESCRIPTION OF THE DRAWINGS

The above and other characteristics, advantages, and features of the presently disclosed subject matter will become more fully understood from the detailed description given hereinbelow and the appended drawings which are given by way of illustration only, and thus are not intended as a definition of the limits of the presently disclosed subject matter, wherein.

DESCRIPTION OF EXEMPLARY EMBODIMENTS

Embodiments of the presently disclosed subject matter are described with reference to the drawings. However, the scope of the presently disclosed subject matter is not limited by the embodiments and the illustrated examples.

Figure 1:
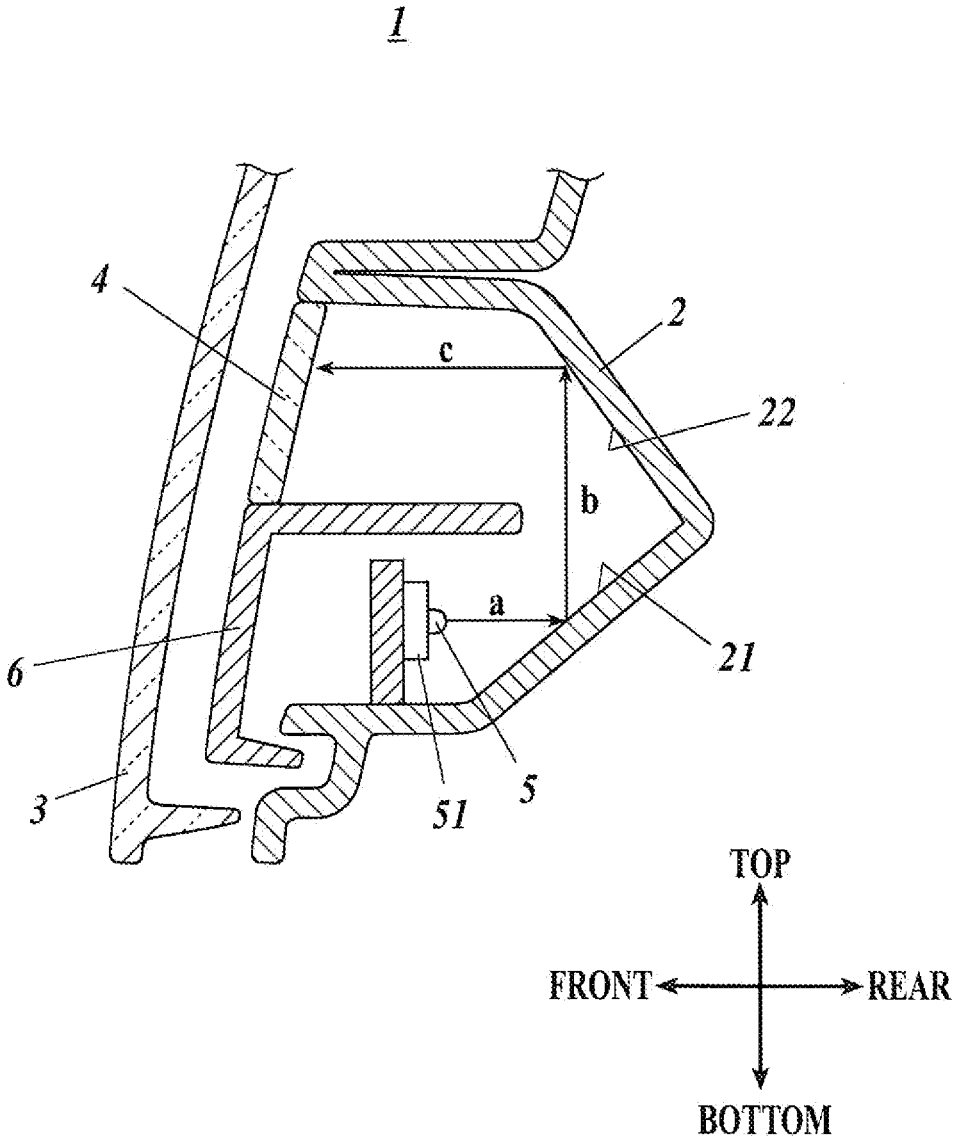
FIG. 1 is a side cross sectional view showing a vehicle light fitting unit of the present embodiment.
Figure 2:
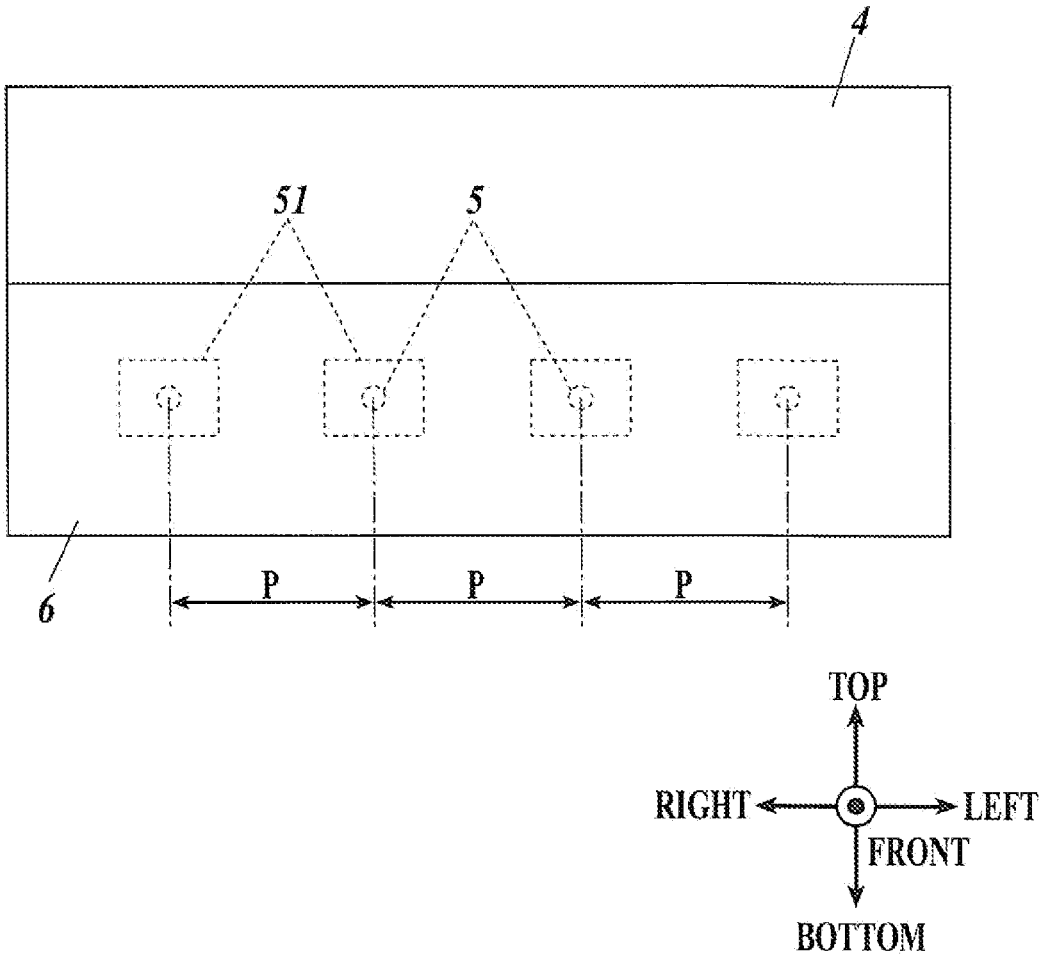
FIG. 2 is a front view showing a main portion of a vehicle light fitting unit of the present embodiment.

FIG. 1 is a side cross section view showing a vehicle light fitting unit 1 of the present embodiment and FIG. 2 is a front view showing a main section of the vehicle light fitting unit 1.

The vehicle light fitting unit 1 is formed with a longer side in a left and right direction and as shown in FIG. 1, includes a housing 2 open to the front evenly to the left and the right.

The rear section of the housing 2 is bent to the front in a right angle, a bottom half plane on an inside composes a first reflecting plane 21, and an upper half plane composes a second reflecting plane 22. The first reflecting plane 21 and the second reflecting plane 22 are planes inclined in an angle of 45 degrees to the rear or the front, and are planes applied with white painting as a surface processing to diffusely reflect the light. The first reflecting plane 21 and the second reflecting plane 22 can be planes in which material is colored white, instead of painting the planes white.

On the front of the housing 2, a transparent outer lens 3 is provided so as to cover the opening of the housing 2. The outer lens 3 and the housing 2 form a light chamber, and an inner lens 4, a plurality of light sources 5, etc. and extension 6 are stored in the light chamber.

Among the above, the inner lens 4 is a transparent plate with a longer side in the left and right direction. The inner lens 4 is provided standing in a position in front of the second reflecting plane 22 so as to cover the upper half section of the opening edge of the housing 2. Grain finishing is performed on the front face of the inner lens 4 in order to diffuse light which transmits the inner lens 4.

The light source 5 is a light emitting body such as a light emitting diode, etc. The light source 5 is positioned in front of the first reflecting plane 21 so that the optical axis points to the rear and is mounted to a substrate 51 which is fixed to a bottom face of the housing 2. As shown in FIG. 2, the light source 5 is aligned in plural numbers (four in the present embodiment) at a predetermined pitch p along the left and right direction. The pitch p between each light source 5 is shorter than a light path length L from the light source 5 to the inner lens 4 passing through the first reflecting plane 21 and the second reflecting plane 22. Here, the light path length L is a light path length of a specular reflection of the light from the light source 5 along the light axis against the first reflecting plane 21 and the second reflecting plane 22. As shown in FIG. 1, the light path length L is represented by a total sum of light path length a from the light source 5 to the first reflecting plane 21 which is the light path to the rear, a light path length b from the first reflecting plane 21 to the second reflecting plane 22 which is the light path upward, and a light path length c from the second reflecting plane 22 to the inner lens 4 which is the light path to the front.

The extension 6 is formed in a substantial L shape from a side view, and is provided surrounding the front and above the light source 5 and also covers the bottom half section of the opening edge of the housing 2. The extension 6 covers and hides the light source 5 so that the light source 5 cannot be seen when viewed from the front of the vehicle light fitting unit 1, and also cuts light so that the light from the light source 5 does not directly enter the second reflecting plane 22.

Figure 3:
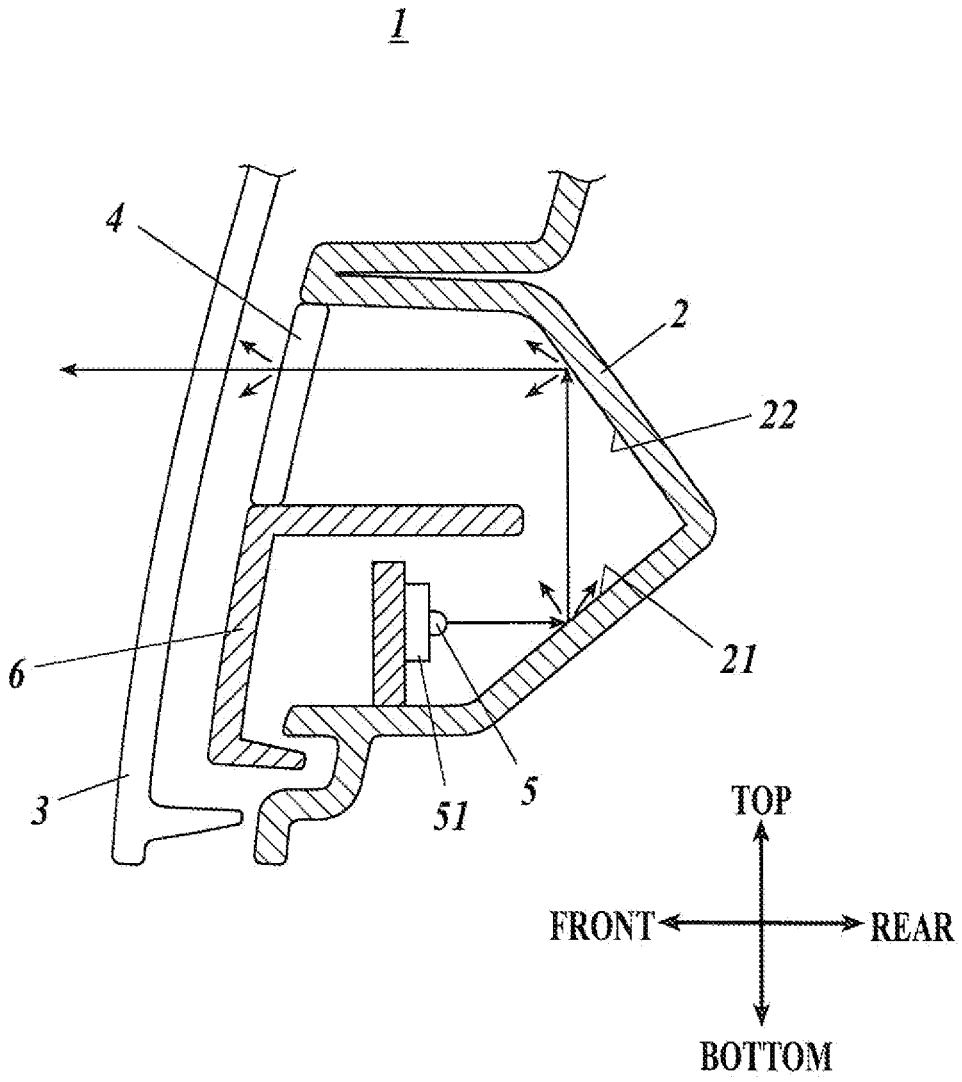
FIG. 3 is a diagram explaining a light path in the vehicle light fitting unit of the present embodiment.

As shown in FIG. 3, according to the vehicle light fitting unit 1 including the above configuration, the light emitted from the light sources 5, etc. is diffusely reflected by the first reflecting face 21, is diffusely reflected again by the second reflecting face 22, and transmits the inner lens 4. Then, the light is further diffused by the grain finishing of the front face of the inner lens 4 and is emitted to the front through the outer lens 3. With this, the light is emitted from the front face of the inner lens 4 and the front face of the outer lens 3 evenly as a plane.

According to the vehicle light fitting unit 1, the light emitted from the light sources 5, etc. is diffusely reflected by the first reflecting plane 21 and the second reflecting plane 22, and then emitted forward through the inner lens 4 and the outer lens 3. Therefore, different from the conventional vehicle light fitting unit in which the light is emitted from the front face of the light guiding body by the light reflected by the reflecting dots provided on the rear face of the light guiding body, the unevenness of brightness between the areas near the reflecting dots and the other areas do not occur. Consequently, the light is emitted from the front face of the inner lens 4 and the front face of the outer lens 3 evenly as a plane.

The pitch p between each light source 5 can be made shorter than the light path L from the light source 5 to the inner lens 4. Therefore, when the front face of the outer lens 3 (inner lens 4) is viewed from the front, the middle portion of the adjacent light emitting portions does not become clearly darker than the light emitting portions emitting light by the light source 5 at a light path length L. Consequently, the light is emitted from the front face of the inner lens 4 and the front face of the outer lens 3 more evenly as a plane.

In a conventional vehicle light fitting unit, light of the light source enters from the side of the light guiding body and light is emitted from the front face of the light guiding body. Therefore, stronger light is emitted from the front face of the light guiding body on the side nearer to the light source and it is necessary to separate the light source from the light guiding body in order to obtain even light emission. According to the vehicle light fitting unit 1 of the present embodiment, the light emitted from the light sources 5, etc. to the rear is reflected to the front again, and the light is emitted from the front face of the outer lens 3 (inner lens 4). Therefore, the inner lens 4 and the light sources 5, etc. do not need to be separated in the up and down direction, and the configuration can be made compact in the up and down direction.

Different from the conventional vehicle light fitting unit in which the light of the light source enters from the side of the light guiding body and the light is emitted from the front face, a light entering lens which allows light to enter the light guiding body efficiently is not necessary. Consequently, the configuration can be made more compact and with lower costs.

The processing for reflection is not necessary on the outer lens 3 and the inner lens 4. Therefore, different from the conventional vehicle light fitting unit in which light is reflected by the reflecting dots provided on the rear face of the light guiding body, the reflecting dots cannot be seen viewed from the front, and merchantability is enhanced.

In a conventional vehicle light fitting unit, light of the light source enters from the side of the light guiding body, and the light is emitted from the front face of the light guiding body. Therefore, it is necessary to form the light guiding body thickly in order to obtain even light emission. According to the vehicle light fitting unit 1 of the present embodiment, the light reflected by the first reflecting plane 21 and the second reflecting plane 22 transmits through the inner lens 4 and the outer lens 3. Therefore, the inner lens 4 and the outer lens 3 do not need to be formed thickly, and the configuration can be made with low costs.

Modification 1

Next, the first modification of the present embodiment is described.

Figure 4:
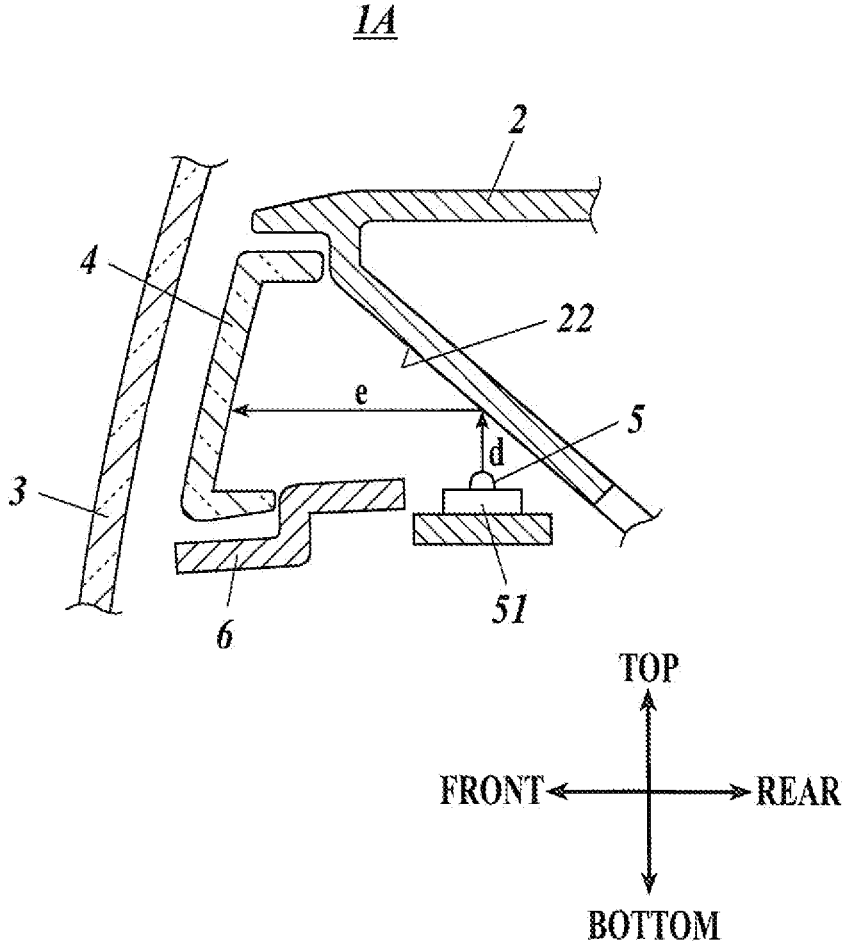
FIG. 4 is a side cross sectional view showing a vehicle light fitting unit of a first modification of the present embodiment.

FIG. 4 is a side cross sectional view of the vehicle light fitting unit 1 of the first modification.

As shown in the diagram, the vehicle light fitting unit 1 of the above embodiment is modified in the vehicle light fitting unit 1A so that the light from the light source is emitted to the front by diffuse reflection only one time. In the vehicle light fitting unit 1A, the housing 2 includes only the second reflecting plane 22 as the reflecting plane, and the light sources 5, etc. are provided below the second reflecting plane 22 so that the light axis points upward. Here, the pitch p1 (not shown) between each light source 5 in the left and right direction is shorter than the light source length L1 represented by a sum of light path length d from the light source 5 to the second reflecting plane 22 which is the light path upward and the light path length e from the second reflecting plane 22 to the inner lens 4 which is the light path to the front. The extension 6 is positioned in front of the light sources 5, etc. The configuration of the other main components is similar to the vehicle light fitting unit 1 of the above embodiment.

In the vehicle light fitting unit 1A, the light emitted from the light sources 5, etc. is diffusely reflected by the second reflecting plane 22. After transmitting through the inner lens 4 and being further diffused by the grain finishing of the front face of the inner lens 4, the light is emitted to the front through the outer lens 3. With this, light is emitted evenly as a plane from the front face of the inner lens 4 and the front face of the outer lens 3.

According to the vehicle light fitting unit 1A, effects obtained by the vehicle light fitting unit 1 of the above embodiment can be similarly obtained. In other words, even if the diffuse reflection to the inner lens 4 is only one time, when the light path length L1 is suitably kept, even light emission as a plane can be obtained.

Modification 2

Next, a second modification of the above embodiment is described.

Figure 5:
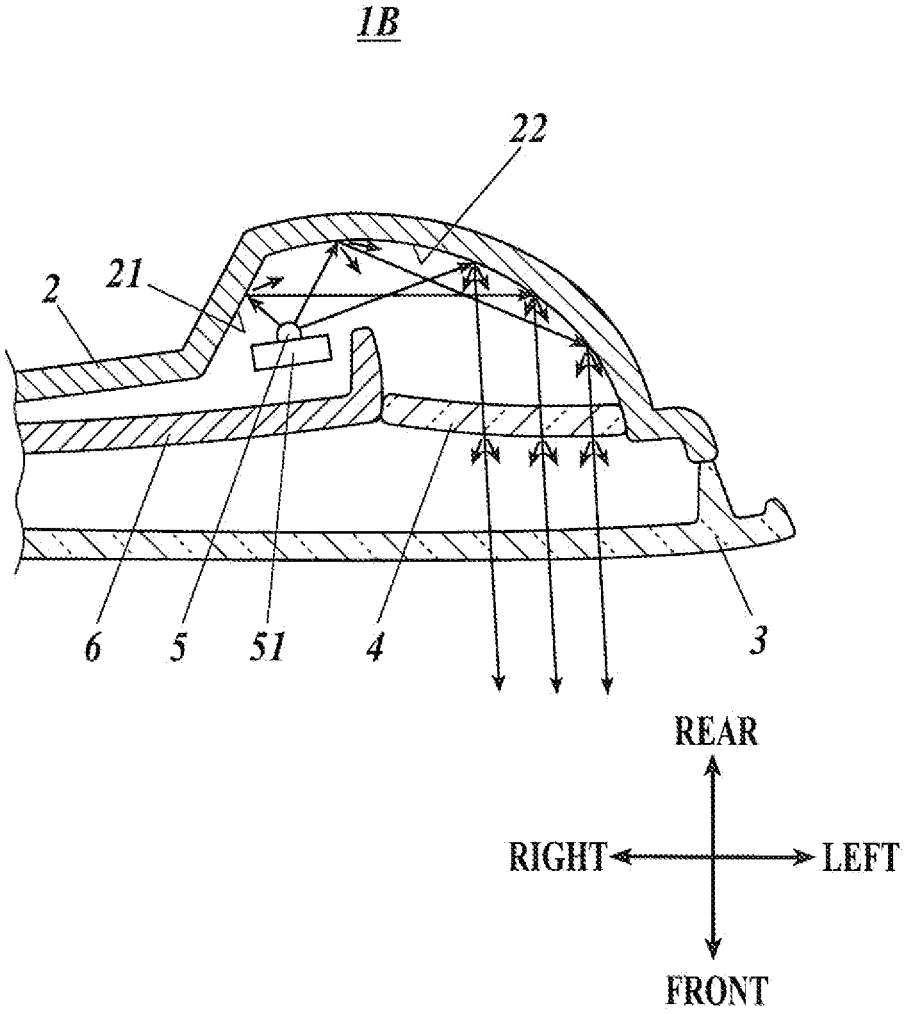
FIG. 5 is a cross section from a planar view showing a vehicle light fitting unit of a second modification of the present embodiment.
Figure 6A:
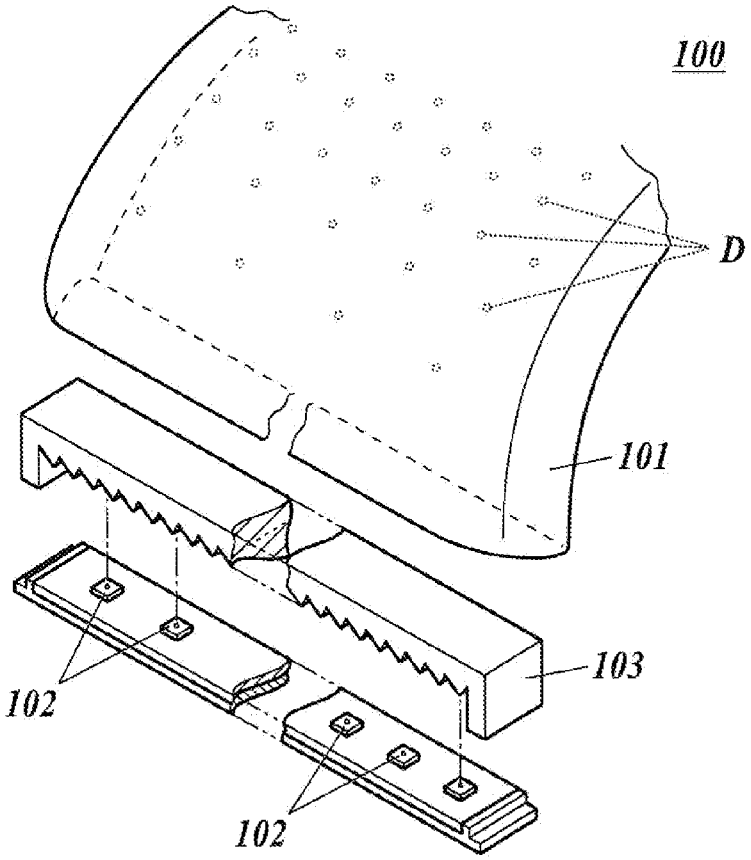
FIG. 6A and FIG. 6B are diagrams explaining a conventional vehicle light fitting unit.
Figure 6B:
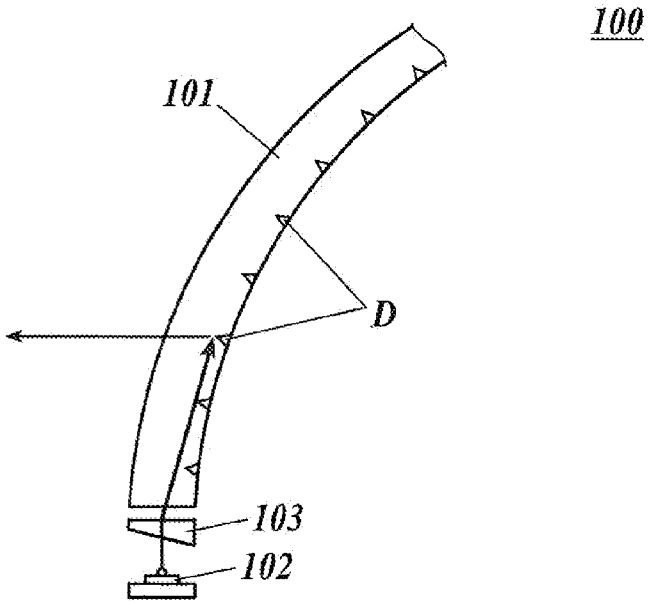

FIG. 5 is a cross section diagram from a planar view of the vehicle light fitting unit 1B of the second modification.

As shown in the diagram, in the vehicle light fitting unit 1B, the first reflecting plane 21 is made shorter in the front and rear direction, and the second reflecting plane 22 is a curved face open to the front. Since the direct light from the light source 5 enters the second reflecting plane 22, in addition to the light diffusely reflected by the first reflecting plane 21, the second reflecting plane 22 can diffusely reflect the direct light from the light source 5 to the inner lens 4.

In the vehicle light fitting unit 1B, different from the vehicle light fitting unit 1 of the above embodiment, the first reflecting plane 21 and the second reflecting plane 22 are provided in the left and the right direction (the first reflecting plane 21 is provided on a side toward the inside of the vehicle, and the second reflecting plane 22 is provided on a side toward the outside of the vehicle). However, this point does not make a difference in the main features between the vehicle light fitting unit 1 and the vehicle light fitting unit 1B. For example, similar to the vehicle light fitting unit 1, the first reflecting plane 21 can face upward and the second reflecting plane 22 can face downward. The configuration of the other main components is similar to the vehicle light fitting unit 1 of the above embodiment.

The light path length L of the vehicle light fitting unit 1B is represented by a total sum of each light path length a to c similar to the above embodiment. However, when the light axis of the light source 5 is pointed to the second reflecting plane 22, the light path length a is a light path length along the light axis from the light source 5 to the second reflecting plane 22. When the light is reflected by the second reflecting plane 22 two times in the light path along the light axis to the inner lens 4, the light path length b is the light path length between each reflecting point on the second reflecting plane 22.

According to the vehicle light fitting unit 1B, effects obtained by the vehicle light fitting unit 1 of the above embodiment can be similarly obtained. Further, since the first reflecting plane 21 is made shorter in the front and rear direction while making the second reflecting plane 22 in a curved face, the depth in the front and rear direction can be made compact compared to the vehicle light fitting unit 1 of the above embodiment.

The embodiments in which the presently disclosed subject matter can be employed is not limited to the above described embodiment(s) and modification(s), and can be suitably changed without leaving the scope of the presently disclosed subject matter.

For example, in the above described embodiment, the first reflecting plane 21 and the second reflecting plane 22 are applied with white painting. However, surface processing such as vapor deposition of aluminum can be performed on either one of the first reflecting plane 21 or the second reflecting plane 22 so that specular reflection of light is obtained. In this case, stronger light can be obtained compared to when the first reflecting plane 21 and the second reflecting plane 22 are both applied with white painting. However, in this case, more even light emission as a plane can be obtained from the light emitting plane by diffuse reflection by the second reflecting plane 22 which is closer to the light emitting plane (outer lens 3) than the first reflecting plane 21.

The pitch p between each light source 5 does not have to be constant in between all light sources 5, as long as the pitch between one light source 5 among the plurality of light sources 5 and another light source 5 adjacent to the one light source 5 is shorter than the light path length L from the one light source 5 to the inner lens 4 passing through the first reflecting plane 21 and the second reflecting plane 22.

The grain finishing of the inner lens 4 does not have to be performed on the front face of the inner lens 4 and can be performed on the rear face of the inner lens 4 or can be performed on both the front face and the rear face of the inner lens 4. The grain finishing can be replaced by another method which can diffuse light, and for example, the inner lens 4 can be made to have a milky white color or the inner lens 4 can include a diffusing agent.

In the second modification of the above embodiment, the second reflecting plane 22 is a curved face, however, as long as the diffuse reflection of the light of the light source 5 to the inner lens 4 is possible, the first reflecting plane 21 can also be made a curved face. Moreover, either one of the first reflecting plane 21 or the second reflecting plane 22 can be made a specular reflecting plane.

According to an aspect of the presently disclosed subject matter there is provided a vehicle light fitting unit that can include:

a plurality of light sources;

a reflecting plane which diffusely reflects light emitted from the plurality of light sources; and a lens which emits the light, which is diffusely reflected by the reflecting plane, to a front direction, wherein the plurality of light sources are each provided so that a pitch between one light source and another light source adjacent to the one light source is made shorter than a light path length from the one light source to the lens passing through the reflecting plane.

The vehicle light fitting unit can further include another reflecting plane which specularly reflects the light emitted from the light source to the reflecting plane, wherein the reflecting plane diffusely reflects the light specularly reflected by the other reflecting plane to the lens.

The vehicle light fitting unit, can further include another reflecting plane which specularly reflects the light diffusely reflected by the reflecting plane to the lens, wherein the lens emits the light specularly reflected by the other reflecting plane to a front direction.

In the vehicle light fitting unit, at least a portion of the reflecting plane can be a curved face.

In the vehicle light fitting unit, the reflecting plane can be a plane painted white or is a plane in which material is colored white.

In the vehicle light fitting unit, grain finishing can be performed on at least one of a front face or a rear face of the lens which transmits the light emitted from the light source.

According to the above aspects, the light emitted from the plurality of light sources is diffusely reflected by the reflecting plane and then emitted to a front direction through a lens. Therefore, different from the conventional vehicle light fitting unit in which light is emitted from the front face of the light guiding body by the light reflected by the reflecting dots provided on the rear face of the light guiding body, unevenness of the brightness between the area near the reflecting dots and the other areas does not occur. Consequently, the light is emitted from the front face of the lens more evenly as a plane.

Since the pitch between one light source and another light source adjacent to the one light source is shorter than a light path length from the one light source to the lens passing through the reflecting plane, when the front face of the lens is viewed from the front, the middle portion of the adjacent light emitting portions does not become clearly darker than the light emitting portion emitting light by the light source at the light path length. Consequently, light is emitted from the front face of the lens even more evenly as a plane.

The entire disclosure of Japanese Patent Application No. 2010-142334 filed on Jun. 23, 2010 including description, claims, drawings and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A vehicle light fitting unit comprising:

a plurality of light sources;

a reflecting plane configured to diffusely reflect light emitted from the plurality of light sources; and a lens configured to transmit the light, which is diffusely reflected by the reflecting plane, to a front direction, wherein the plurality of light sources are each provided so that a pitch between one light source and another light source adjacent to the one light source is shorter than a light path length from the one light source to the lens passing via the reflecting plane, and wherein the plurality of light sources are positioned such that the optical axis of each light source points in a direction substantially opposite to the front direction.

2. The vehicle light fitting unit according to claim 1, further comprising:

another reflecting plane configured to reflect the light emitted from the plurality of light sources to the reflecting plane, wherein the reflecting plane is configured to diffusely reflect the light reflected by the another reflecting plane to the lens.

3. The vehicle light fitting unit according to claim 2, wherein the another reflecting plane is configured to specularly reflect the light emitted from the plurality of light sources to the reflecting plane.

4. The vehicle light fitting unit according to claim 1, further comprising:

another reflecting plane configured to reflect the light diffusely reflected by the reflecting plane to the lens, wherein the lens is configured to transmit the light reflected by the another reflecting plane to a front direction.

5. The vehicle light fitting unit according to claim 4, wherein the another reflecting plane is configured to specularly reflect the light emitted from the plurality of light sources to the lens.

6. The vehicle light fitting unit according to claim 1, wherein at least a portion of the reflecting plane is a curved face.

7. The vehicle light fitting unit according to claim 1, wherein the reflecting plane is a plane painted white or is a plane in which material is colored white.

8. The vehicle light fitting unit according to claim 1, wherein at least one of a front face and a rear face of the lens which transmits the light emitted from the plurality of light sources includes grain finishing.

9. The vehicle light fitting unit according to claim 1, wherein each light path length from each light source to the lens passing via the reflecting plane is substantially equal to each other light path length from each other light source to the lens passing via the reflecting plane.

10. A vehicle light fitting unit comprising:

a plurality of light sources;

a reflecting plane configured to diffusely reflect light emitted from the plurality of light sources; and a lens configured to transmit the light, which is diffusely reflected by the reflecting plane, to a front direction, wherein the plurality of light sources are each provided so that a pitch between one light source and another light source adjacent to the one light source is shorter than a light path length from the one light source to the lens passing via the reflecting plane, and wherein the plurality of light sources are arranged such that the optical axis of each light source points in a direction substantially perpendicular to the front direction.

* * * * *